US005713173A

United States Patent [19]

Von Langsdorff et al.

[11] Patent Number: 5,713,173

[45] Date of Patent: Feb. 3, 1998

[54] HEXAGONAL MOSAIC PAVING PATTERN

[76] Inventors: Harald Von Langsdorff, 1688 Caverly Court, Mississauga, Ontario, Canada, L5L 3L7; Fritz Von Langsdorff, Blutenstrasse 12, D-76437, Rastatt, Germany

[21] Appl. No.: 334,218

[22] Filed: Nov. 4, 1994

[51] Int. Cl.[6] ..... E04F 15/08

[52] U.S. Cl. ..... 52/311.2; 52/316; 52/596; D25/113

[58] Field of Search ..... 52/311.2, 314, 52/315, 316, 596; D25/113

[56] References Cited

U.S. PATENT DOCUMENTS

| | | | |
|---|---|---|---|
| D. 97,318 | 10/1935 | Galliano . | |
| 479,126 | 7/1892 | See | 52/311.2 |
| 1,864,153 | 6/1932 | Solon | 52/316 X |
| 1,877,481 | 9/1932 | Prouty | 52/316 X |
| 2,101,019 | 12/1937 | Bowes . | |
| 2,162,777 | 6/1939 | Hagopian | 52/316 X |
| 2,388,880 | 11/1945 | Stitt | 52/316 X |
| 2,710,335 | 6/1955 | Wong . | |
| 3,270,473 | 9/1966 | Smith . | |
| 3,875,716 | 4/1975 | Eusemann | 52/311.2 |
| 4,544,305 | 10/1985 | Hair | 52/311.2 X |
| 4,722,158 | 2/1988 | Urdaneta | 52/316 |

OTHER PUBLICATIONS

Architectural Record, Product Reports, Jul. 1957.

Journal of the American Concrete Institute, Plastic Forms for Architectural Concrete, May 1960.

1981 Sweet's Catalog Section 9.18 EL, p. 4, illustration entitled "Geometrico A".

Design on File Book dated 9, 1984, Patterns Section #2000, p. 10.

Page from a publication showing as Bild 4.1.22 Patchwork quilt by Jinny Beyer (no date).

Page from a publication identified as Bild 3.3.19 showing various designs of parquets (no date).

*Primary Examiner*—Christopher Kent

[57] ABSTRACT

A paving element has a body with oppositely directed major faces interconnected by a peripheral side wall. One of said major faces is generally planar and has at least one set of a plurality of predefined areas formed thereon. Adjacent areas of the set have a surface finish to provide a contrasting visual effect relative to other areas of the set. The finish and disposition of the areas is configured to provide a representation of abutting orthogonally disposed surfaces so that when a plurality of such sets is arranged in seriatim, a visual impression of stepped surfaces at different levels is provided.

21 Claims, 4 Drawing Sheets

HEXAGONAL MOSAIC PAVING PATTERN

The present invention relates to paving elements.

It is common practice to pave a surface to provide a durable wear resistant covering. The paving may be cast in situ such as with a concrete slab or may use individual paving elements which are placed next to one another to cover the entire area. In more recent years, paving elements have been utilized with interlocking geometric shapes that provide a stable covering but at the same time permit a convenient size of paving element to facilitate handling.

By using individual paving elements, different patterns can be achieved from complimentary shaped paving elements of different sizes and configurations. It is an advantage of these paving elements that different patterns may be generated but as the patterns become more complex, the number of different elements necessary to form the pattern increases. Thus installation time and expense increases and in some cases may render the more attractive patterns prohibitively expensive.

There is a need to provide paving elements with immediate visual impact and which may be used to add architectural highlights, such as, contours or changes in elevation to break-up an otherwise planar area. However, designs that provide such an effect require large numbers of individual elements with the attendant expense.

It is therefore an object of the present invention to provide paving elements which obviate the above disadvantages.

In general terms the present invention provides a paving element in which the upper surface of the paving element is sub-divided into discrete areas with differing surface finishes. The surface finishes are chosen to provide the effect of shading and create a visual representation of orthogonal abutting surfaces. When elements are placed in seriatim a representation of a stepped surface is created. The paving element therefor permits repeating patterns representing step surfaces to be laid but reduces the number of individual elements necessary to achieve this effect.

Embodiments of the present invention will now be described by way of example only with reference to the accompanying drawings in which.

Figure 2:
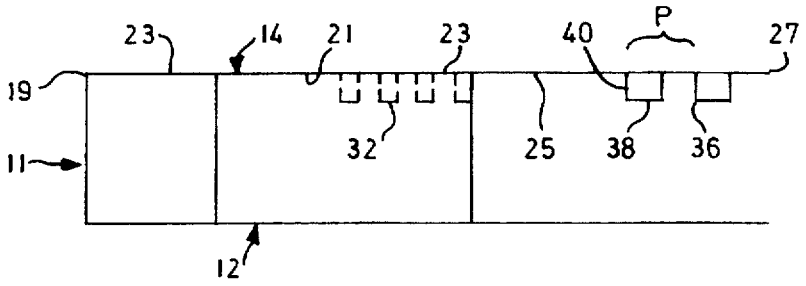
FIG. 2 is a side view in the direction of arrow II of FIG. 1.
Figure 3:
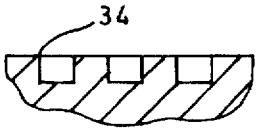
FIG. 3 is an opposite side view in the direction of arrow III of FIG. 1.
Figure 1:
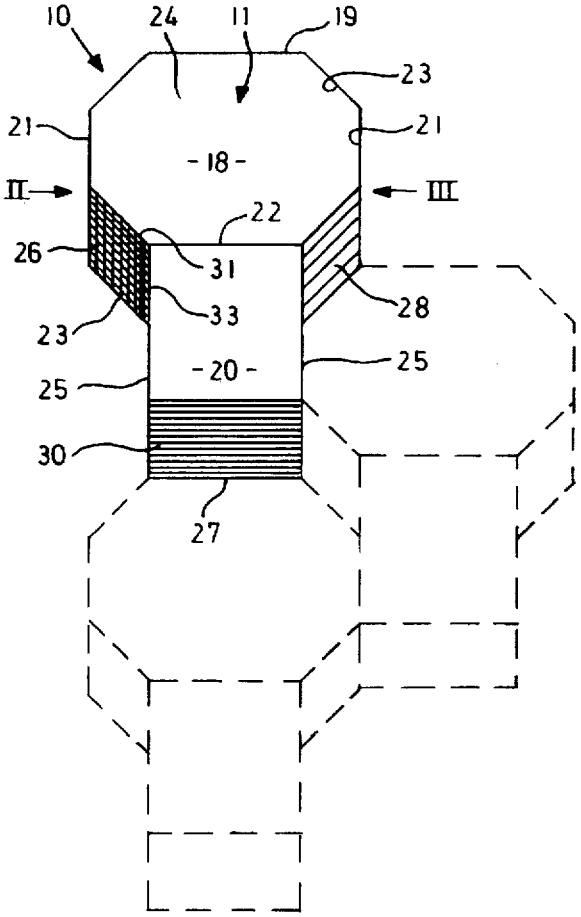
FIG. 1 is a plan view of a first embodiment of a paving element.

Referring therefore to FIGS. 1 through 3, a paving element 10 has a body 11 with a pair of oppositely directed generally planar faces 12,14 interconnected by a sidewall 16. The face 12 is intended to be placed toward the ground and therefore is designated a lower face 12 and the face 14 provides a load receiving surface that would be upwardly directed when installed and therefore is referred to as the upper face 14.

In the embodiment of FIGS. 1 through 3, the body 11 includes an octagonal head 18 and a rectangular tail 20. The head 18 and tail 20 are integrally formed but are visually separated by a dummy groove 22 formed in the upper face 14.

The head is delimited by a lateral edge 19 and a pair of longitudinal edges 21 with inclined edges 23 defining the flanks of the octagon. The tail 20 has a pair of longitudinal edges 25 which extend from the inclined edges 23 and are interconnected by a lateral edge 27 at the distal end of the tail 20.

The paving element 10 is formed from concrete by a suitable moulding technique and the appropriate constituents of the concrete are well known in the art and need not be exemplified further.

The upper face 14 is formed with four visually distinct areas indicated 24, 26, 28 and 30. Each of the areas 24 through 30 has a surface finish that provides a visually contrasting effect from the other areas so that in the embodiment of FIG. 1, the area 24 covers the majority of the face 14 and visually is of the lightest shade. The areas 26,28 are parallelograms having one side 31 corresponding to the inclined edge 23 and the other side 33 determined by the spacing of the groove 22 from the intersection of the edges 23,25. The area 30 is a rectangular area at the distal end of the tail 20 and the side of the rectangle extending along the longitudinal edge 25 of the tail 20 corresponds to the side 33 of the parallelogram areas 26,28.

The disposition and relative shading of the areas 24 through 30 provide a visual representation of abutting orthogonally disposed surfaces on the planar upper surface 14. Thus each of the shaded areas 26, 28 and 30 provide a visual effect of a vertical surface extending along a portion of periphery of the horizontal area 24. When installed next to a similar paving element, as shown in chain dot line in FIG. 1, the area 24 appears elevated by a height corresponding to the side 33 of the parallelogram area 26, 28.

The surface finish provided to the areas 26, 28 and 30 to provide the visually contrasting areas can best be seen in FIGS. 2 and 3. The areas 26, 28, 30 are provided with parallel spaced grooves 32, 34, 36 respectively. The grooves 32, 34 extend parallel to the inclined edges 23 of the head 18 and the grooves 36 extend parallel to the lateral edge 27 of the tail 20.

Each of the grooves 32,34,36 has a base 38 parallel to the face 14 and perpendicular walls 40 to provide a rectangular cross section for the groove.

To provide the visual contrast between adjacent areas and simulate the shading of a stepped surface, the grooves 32 associated with the area 26 are narrower and spaced more closely to one another than the grooves 34 associated with the area 28 or the grooves 36 associated with the area 30. In one practical embodiment, the pitch P of the grooves in the area 25 is half that of the grooves 36 in the area 30 which in turn is half that of the grooves 34 in the area 28. In each case the width of the groove is half of the pitch P between the grooves.

The grooves 32, 34, 36 may be formed in the surface 14 during production by suitable configuration of the mould and the different spacing of the grooves provides a different visual effect for each area. The overall effect obtained however is to represent orthogonally disposed surface. Accordingly, when additional paving elements of similar configuration are nested with the longitudinal edges 21 of the head portion 18 of an adjacent element abutting the longitudinal edges 25 of the tail 20, a stepped effect of a surface at different levels is obtained.

Figure 4:
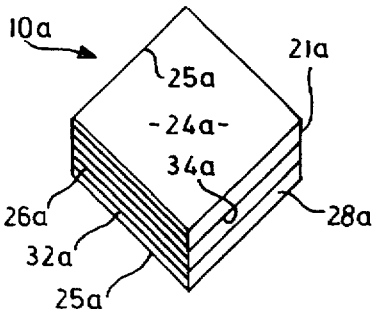
FIG. 4 is a plan view of a first alternative embodiment paving element.
Figure 5:
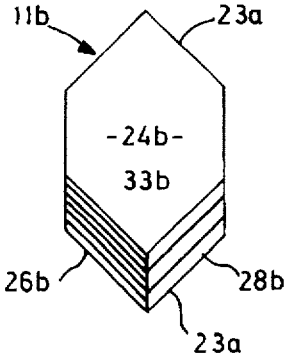
FIG. 5 is a plan view of a yet further alternative embodiment of paving element.

A similar effect may be obtained with other configurations of paving elements as shown in FIGS. 4 and 5 where like components will be denoted with suffixes "a" and "b" respectively. In the arrangement of FIG. 4, a hexagonal paving element 10*a* has two pairs of inclined edges 25*a* and a pair of longitudinal edges 21*a* that are shorter than the edges 25*a*. Three visually distinct areas 24*a*, 26*a*, 28*a* are provided on the upper face 14*a*. The areas 26*a*, 28*a* are each parallelograms having one side corresponding to the inclined edges 23*a* and the other side corresponding the longitudinal edges 21*a* so that the sides of the area 24*a* form a rhombus. Each of the areas 26*a*, 28*a* are formed by respective grooves 32*a*, 34*a* with the spacing of grooves 32*a* closer than those of 34*a*.

The embodiment of FIG. 5 has a hexagonal body 11*b* with visually contrasting areas 24*a*, 26*b*, 28*b*. The areas 26*a*, 28*b* are parallelograms disposed along a pair of adjacent inclined edges 23*a*. The side 33*b* of the parallelogram is selected to provide an equal side hexagonal area 24*b* to provide the impression of vertical surfaces along the one margin of the upper face 14.

Figure 6:
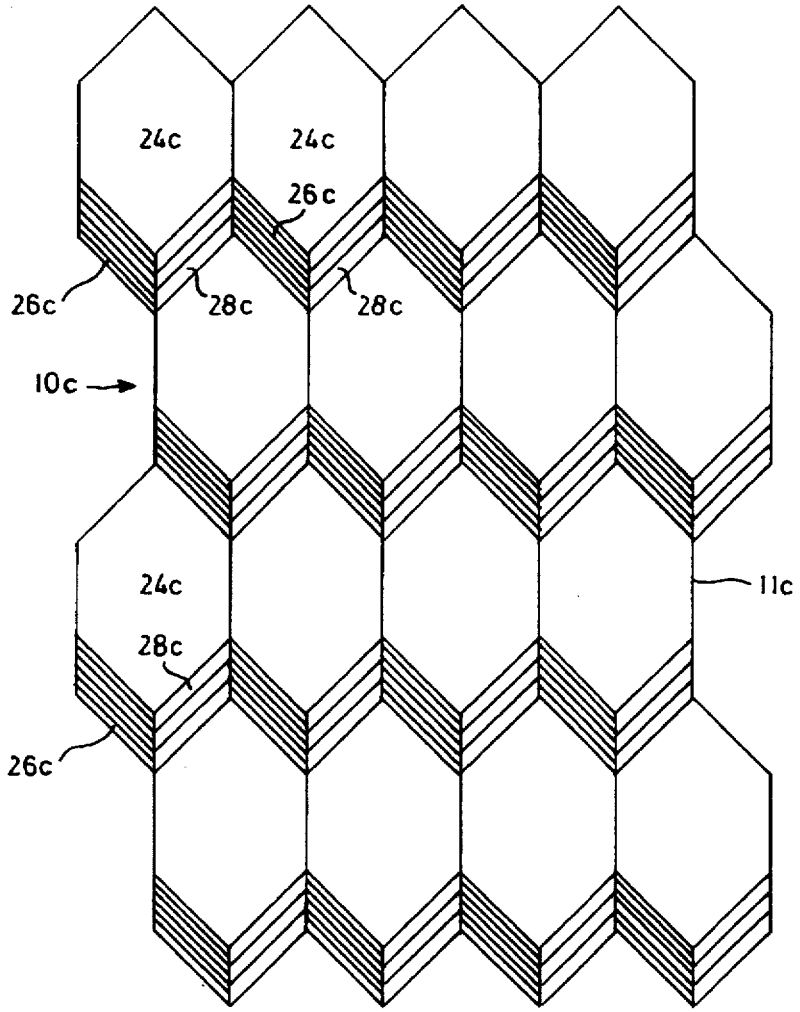
FIG. 6 is a plan view of a unitary paving element incorporating a repeating pattern similar to that shown on the individual element of FIG. 5.

The embodiment of FIGS. 1 through 5 show a paving element with a single set of contrasting areas 24, 26, 28, 30. However, as shown in FIG. 6, each paving element 10 may be formed with multiple sets of contrasting areas each of which provides a visual representation of abutting orthogonally disposed surfaces by virtue of the graduated shading achieved in the different areas. In the arrangement shown in FIG. 6, each paving element 10*c* includes 16 sets of visually contrasting areas each denoted 24*c*,26*c*,28*c* and provides a body 11*c* of a shape that may be nested with a similar element to provide a repetition of the pattern.

Figure 7:
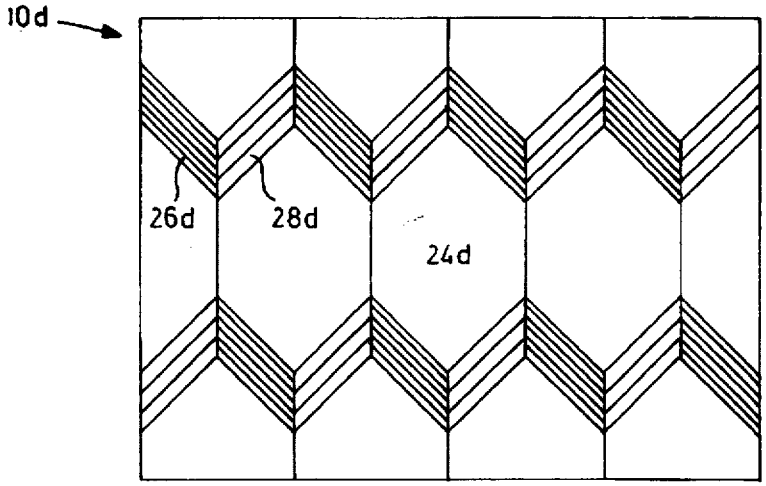
FIG. 7 is a plan view of a rectangular paving element having a pattern similar to that shown in FIG. 6.

Alternatively, as shown in FIG. 7, the pattern may be formed on a rectangular paving element 10*d* having complete and partial sets of patterns but which repeat from element to element. Again, the visually distinct areas may be provided by in situ moulding of grooves of different pitch during production to provide the visual effect of the orthogonally disposed surfaces.

Figure 8:
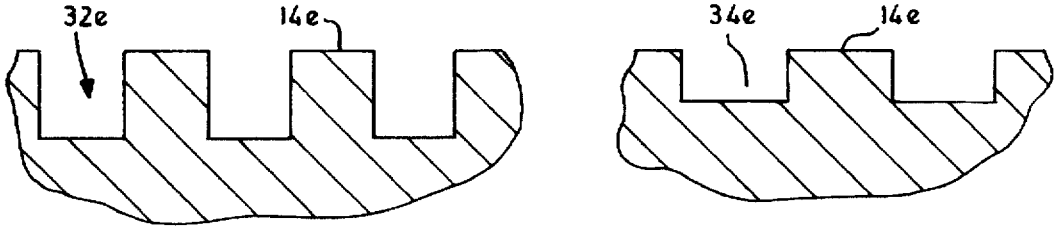
FIG. 8 is a pair of side views of portions of an alternative arrangement of surface finish to that shown in FIG. 2.

In the arrangement shown in FIGS. 1 through 3, the visually distinct areas are obtained by varying the pitch and width of the grooves but as seen in FIG. 8, the same effect may be achieved by maintaining a constant pitch but varying the depth of the individual grooves. FIG. 8 represents partial sections through the equivalent of areas 26 and 28 of the paving element 10 in FIG. 1 and it will seen that in this embodiment the grooves 32*e* are deeper than the grooves 34*e*. The effect therefore is to provide a heavier shading or shadow by the deeper grooves so that a darker area is defined.

Figure 9:
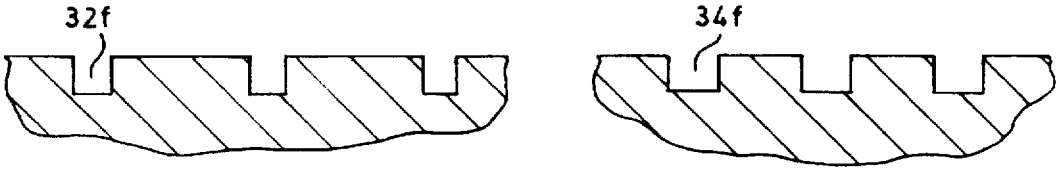
FIG. 9 is a view similar to FIG. 8 showing further alternative arrangement of surface finish.

Alternatively, as shown in FIG. 9, the visually distinct areas may be provided by varying the spacing between or pitch of the grooves 32*f*, 34*f*, but maintaining a uniform width of groove. Thus in the arrangement shown in FIG. 2, the spacing between grooves 32,34 corresponds to the width of the grooves whereas as shown in FIG. 9, the spacing between the grooves is different to that of the width of the groove. For lighter shading, the space in between the grooves is greater than for darker shading.

Figure 10:
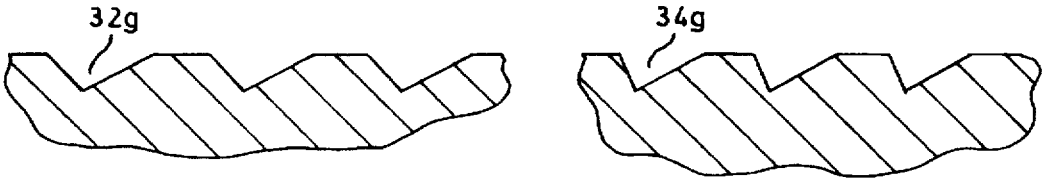
FIG. 10 is a further arrangement of surface finish to that shown in FIGS. 8 and 9.

Moreover, as shown in FIG. 10, the grooves 32*g*,34*g* need not be of rectangular cross-section but may be asymmetric sloped sides with the steepness of the sides being varied to provide the requisite shading.

Figure 11:
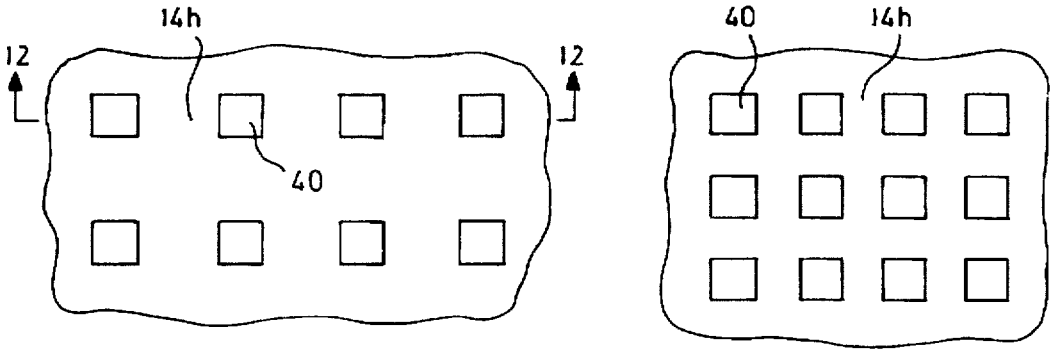
FIG. 11 is a plan view of different portions of the paving element shown in FIG. 1 with alternative configurations of surface finish.
Figure 12:
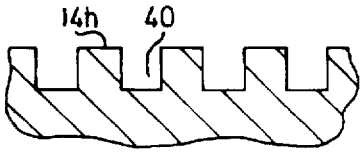
FIG. 12 is a view on the line 12—12 of FIG. 11.
Figure 13:
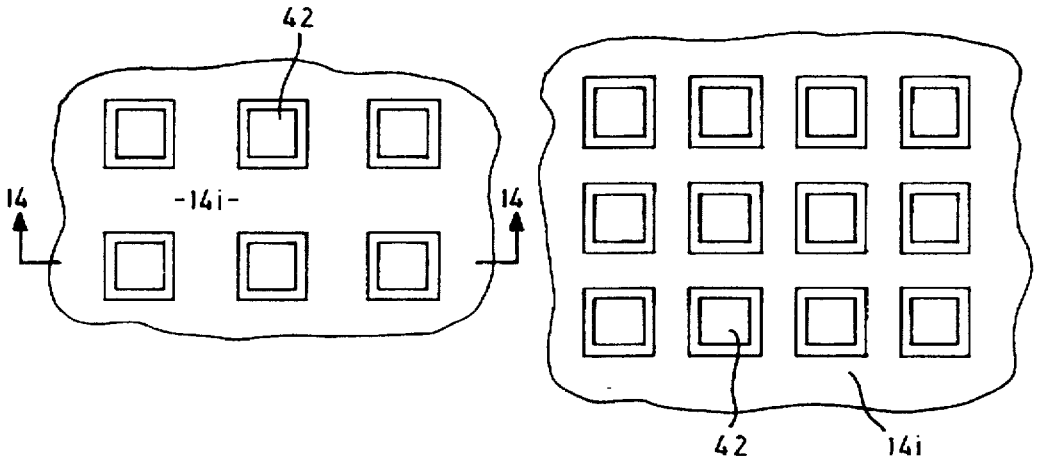
FIG. 13 is a view similar to FIG. 11 of a still further surface finish utilized in select areas of the embodiment of FIG. 1.
Figure 14:
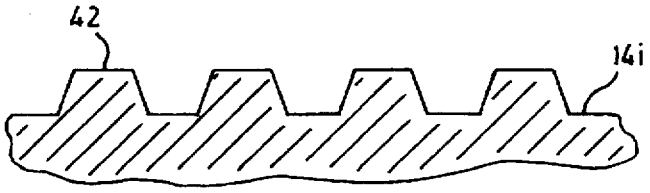
FIG. 14 is a section on the line 14—14 of FIG. 13.

In the above embodiments, the grooves extend continuously across their respective areas. A similar effect may be achieved by having discrete surface discontinuities. Thus, as shown in FIGS. 11 and 12, a series of depressions 40 of square cross-section may be formed in the surface 14*h* with the spacing between the depressions 40 being varied to vary the shading effect. Conversely, the surface 14*i* may be provided with upstanding pyramidal projections 42 as shown in FIGS. 13 and 14 with again the spacing between adjacent projections 42 determining the shading effect.

If necessary, the shading effect may be enhanced by application of paint of other colorant to the grooves after molding.

In each of the above examples, the surface finish for the adjacent areas of each set is formed during production of the element 10. As an alternative production technique, however, the surface finish can be obtained after production as shown in the embodiment of FIGS. 15 and 16.

Figure 15:
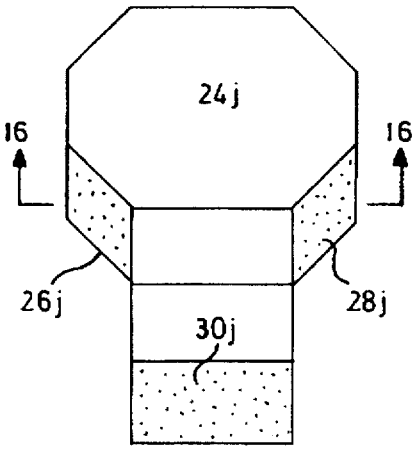
FIG. 15 is a plan view similar to FIG. 1 of a alternative arrangement of a paving element.
Figure 16:
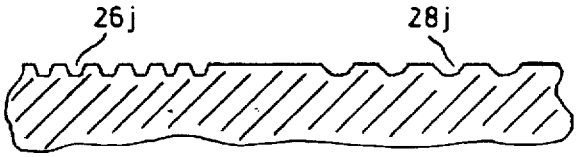
FIG. 16 is a view on the line 16—16 of FIG. 15.

FIG. 15 is a view similar to that of FIG. 1 in which the areas 26*j*, 28*j* and 30*j* are finished to provide a different surface texture from the area 24*j*. The different surface texture is achieved by sandblasting with the roughness of the surface determining the visual effect. In the embodiment of FIG. 15, the surface 26*j* is subjected to the most prolonged sandblasting and so has the roughest surface texture whereas the surface 28*j* is subjected to less sandblasting and therefore less surface roughness. The degree of roughening will determine the shading with the pattern being selected to provide the visual impression of abutting orthogonal surfaces. Although sandblasting has been exemplified in the above embodiment, similar techniques can be obtained through hammering the areas of the upper surface 14 or by selected washing of the areas during curing so that the aggregate is exposed in those areas. The degree of exposure determines the shading effect obtained.

A similar technique may be utilized by using retarding paper which inhibits the binding of the cement between the aggregate and allows for subsequent removal. It will be seen therefore that a unitary element is provided in which surface treatment of selected areas provides the requisite visual effect without the necessity to build a pattern from individual elements.

We claim:

1. A paving element having a body with oppositely directed major faces interconnected by a peripheral side wall, one of said major faces being generally planar and having at least one set of at least three distinct predefined and contiguous areas formed thereon, each of said areas of said set having a different surface finish to provide a contrasting visual effect relative to other areas of said set, each of said areas of said set being polygonal with one of said areas being delimited by a pair of converging linear edges, a pair of the other of said areas being disposed along respective ones of said edges and each of said pair of other areas having one pair of sides extending parallel to said respective edge, said pair of sides in each of said other of said areas being spaced apart uniformly, said finish and disposition of said areas of each set being configured to provide a representation of abutting orthogonally disposed surfaces and said body being configured to permit a plurality of elements to be arranged in seriatim along a predetermined axis with the orientation of said sets relative to said axis maintained whereby a plurality of such sets arranged in seriatim provides a visual impression of stepped surfaces at different levels.

2. A paving element according to claim 1 wherein said one major surface has a treatment applied to selected ones of said areas to provide said contrasting visual effect.

3. A paving element according to claim 2 wherein said treatment includes discontinuities in said planar surface.

4. A paving element according to claim 3 wherein said discontinuities are localized and discrete within each area.

5. A paving element according to claim 3 wherein said discontinuities are provided by spaced parallel grooves in said planar surface.

6. A paving element according to claim 5 wherein grooves in one of said areas are spaced differently to grooves in another one of said areas.

7. A paving element according to claim 5 wherein grooves in one of said areas are of different depth to grooves in another one of said areas.

8. A paving element according to claim 5 wherein said grooves are rectangular in cross section.

9. A paving element according to claim 5 wherein said grooves are asymmetric.

10. A paving element according to claim 4 wherein said localized discontinuities are provided by depressions in said planar surface within said selected ones of said areas.

11. A paving element according to claim 10 wherein the depressions are uniformly distributed within each of said selected ones of said areas.

12. A paving element according to claim 11 wherein the distribution of depressions in one of said selected areas is different to the distribution in another of said selected areas.

13. A paving element according to claim 4 wherein said localised discontinuities are discrete projections within each of said selected areas.

14. A paving element according to claim 13 wherein said projections are uniformly distributed within each of said selected areas.

15. A paving element according to claim 14 wherein the distribution within one of said selected areas is different to the distribution within another of said selected areas.

16. A paving element according to claim 2 wherein said treatment includes varying the texture of said areas to provide a different surface finish in each of said areas.

17. A paving element according to claim 1 wherein each of said areas is polygonal.

18. A paving element according to claim 4 wherein said major face includes only complete sets of said areas.

19. A paving element according to claim 1 wherein said peripheral side wall is configured to abut and interlock with an adjacent paving element.

20. A paving element having a body with oppositely directed major faces interconnected by a peripheral side wall, one of said major faces being generally planar and having at least one set of a plurality of predefined areas formed thereon, each of said predefined areas of said set being polygonal with one of said predefined areas having a pair of converging linear edges, a pair of the other of said predefined areas being disposed along respective ones of said edges and each having one pair of sides extending parallel to said respective one edge, said pair of predefined areas of said set having discontinuities in said planar surface of said major face to provide a contrasting visual effect relative to said one predefined area of said set, said disposition of said areas of each set being configured to provide a representation of abutting orthogonally disposed surfaces whereby a plurality of such sets arranged in seriatim provides a visual impression of stepped surfaces at different levels.

21. A paving element according to claim 20 wherein said discontinuities are provided by spaced parallel grooves in said planar surface in adjacent areas being spaced differently to provide a visually contrasting effect therebetween.

* * * * *